US006402561B1

(12) United States Patent
Chen

(10) Patent No.: US 6,402,561 B1
(45) Date of Patent: Jun. 11, 2002

(54) REDUCED CROSS TALK ELECTRICAL CONNECTOR

(75) Inventor: Michael Chen, Taipei (TW)

(73) Assignee: Surtec Industries Inc. (TW)

( * ) Notice: Subject to any disclaimer, the term of this patent is extended or adjusted under 35 U.S.C. 154(b) by 24 days.

(21) Appl. No.: 09/664,367

(22) Filed: Sep. 18, 2000

(51) Int. Cl.[7] ..... H01R 24/00
(52) U.S. Cl. ..... 439/676; 439/941
(58) Field of Search ..... 439/676, 941, 439/344, 79, 862

(56) References Cited

U.S. PATENT DOCUMENTS 4,269,467 A * 5/1981 Hughes ..... 439/676
4,648,678 A 3/1987 Archer
4,941,848 A * 7/1990 Phillipson et al. ..... 439/607
5,674,093 A 10/1997 Vaden

* cited by examiner

*Primary Examiner*—P. Austin Bradley
*Assistant Examiner*—Ross Gushi
(74) *Attorney, Agent, or Firm*—Birch, Stewart, Kolasch & Birch, LLP

(57) ABSTRACT

An electrical connector capable of reducing cross talk includes a body and a plurality of metal wires. The body is composed of a seat, a pressing element and a cap. The seat is formed with a plurality of grooves where adjacent grooves are located in two different planes. The wires are mounted into the grooves so that adjacent wires are located in different planes so as to reduce cross talk. Those parallel wires located in a same plane are formed into a necked portion so as to enhance compensation, improve the transmission performance and meet the requirements of Category 5e in EIA/TIA standard.

8 Claims, 5 Drawing Sheets

REDUCED CROSS TALK ELECTRICAL CONNECTOR

BACKGROUND OF THE INVENTION

1. Field of Invention

The present invention generally relates to an electrical connector applied to transmit electrical signals, and more particularly relates to an electrical connector which can reduce cross talk induced by closely spaced contacts, enhance transmission performance, and meet the EIA/TIA, Category 5e, standard.

2. Related Art

Information transmissions through network communication are recently more and more popular. The applications are getting wider. As a demand, the high speed and high efficiency transmissions require high quality cabling and connectors. Generally, the network communication paths are composed of transmission media and electrical connectors. On the transmission media, there are twisted pair cables, coaxial cables, and optical fibers. There are a certain defects occurred in the communication paths which will get worsen as the frequency of signals getting higher. The defects may come from:

1) cross talk, which is induced by electromagnetic interference between closely spaced cables or contacts;
2) return loss, which is caused by reflections in the communication system due to the discontinuous impedance; and
3) attenuation of signal. The level of signal decreases when the transmission distance increases.

Taking unshielded twisted pair (UPT) cabling for example, the cable includes two isolated copper wires twisted with a certain pitch and a certain manner. A pair or two pairs of twisted cables constitute a communication chain as a simplest transmission medium. The twisted pairs are commonly used in computer communication networks. But, in their connecting hardware, cross talk is induced due to capacitive and inductive couplings between adjacent conductors. As the frequency of the signal increases, the magnitude of the cross talk is logarithmically increased, and the impedance also increases, which badly distort the high frequency signals.

For the aforesaid reasons, the EIA/TIA 568 standard established by Electronic Industries Association has been adopted into IEEE 802.3u standard by the Institute of Electrical and Electronics Engineers, Inc. The IEEE 802.3u standard includes all the standards for the transmission medium and connectors, and classifies them into several categories. For example, "Category 3" are network cabling for voice which use solid copper wires of 24AWG with impedance 100Ω and certifies UTP for data transmission up to 10 Mbps; "Category 4" are the same as Category 3 but with data transmission up to 16 Mbps; "Category 5" are the same as Category 3 but with data transmission up to 100 Mbps. Another category with tighter requirements than Category 5 is "category 5e" which requests for a limited extent of return loss caused by reflections in the communication system due to the discontinuous impedance.

There have been prior arts to solve the problem of decreased performance in transmitting higher frequency signals. For example, in U.S. Pat. No. 4,648, 678, the adjacent terminals for a connector are settled on two different planes. A further improvement of connector disclosed by U.S. Pat. No. 5,674, 093 is to differentiate the bending angles of adjacent terminal legs, so that the adjacent terminal legs are not parallel to each other, and, the electrical signal transmission characteristics of said connector is enhanced. The terminal legs in these connectors have sharp angle bends to be contacted with contact ports of a terminal plug. Since the terminal legs are all located aside the connector body, the terminal legs will have different distances from two sideward connecting posts on the printed circuit board when the connector is being mounted in center of a printed circuit board. As a result, the different distances cause unbalanced paths and unequal cross talk on two sides.

SUMMARY OF THE INVENTION

It is therefore an object of the present invention to provide an electrical connector which can improve communication quality for higher frequency transmission and meet the requirement of Category 5e in EIA/TIA standard.

To achieve the aforesaid objects, an electrical connector capable of reducing cross talk according to the present invention includes a body and a plurality of metal wires. The body is composed of a seat, a pressing element and a cap. The seat is formed with a plurality of grooves where adjacent grooves are located in two different planes. The wires are mounted into the grooves so that adjacent wires are located in different planes so as to reduce cross talk. Those parallel wires located in a same plane are formed into a necked portion so as to enhance compensation, improve the transmission performance and meet the requirements of Category 5e in EIA/TIA standard.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
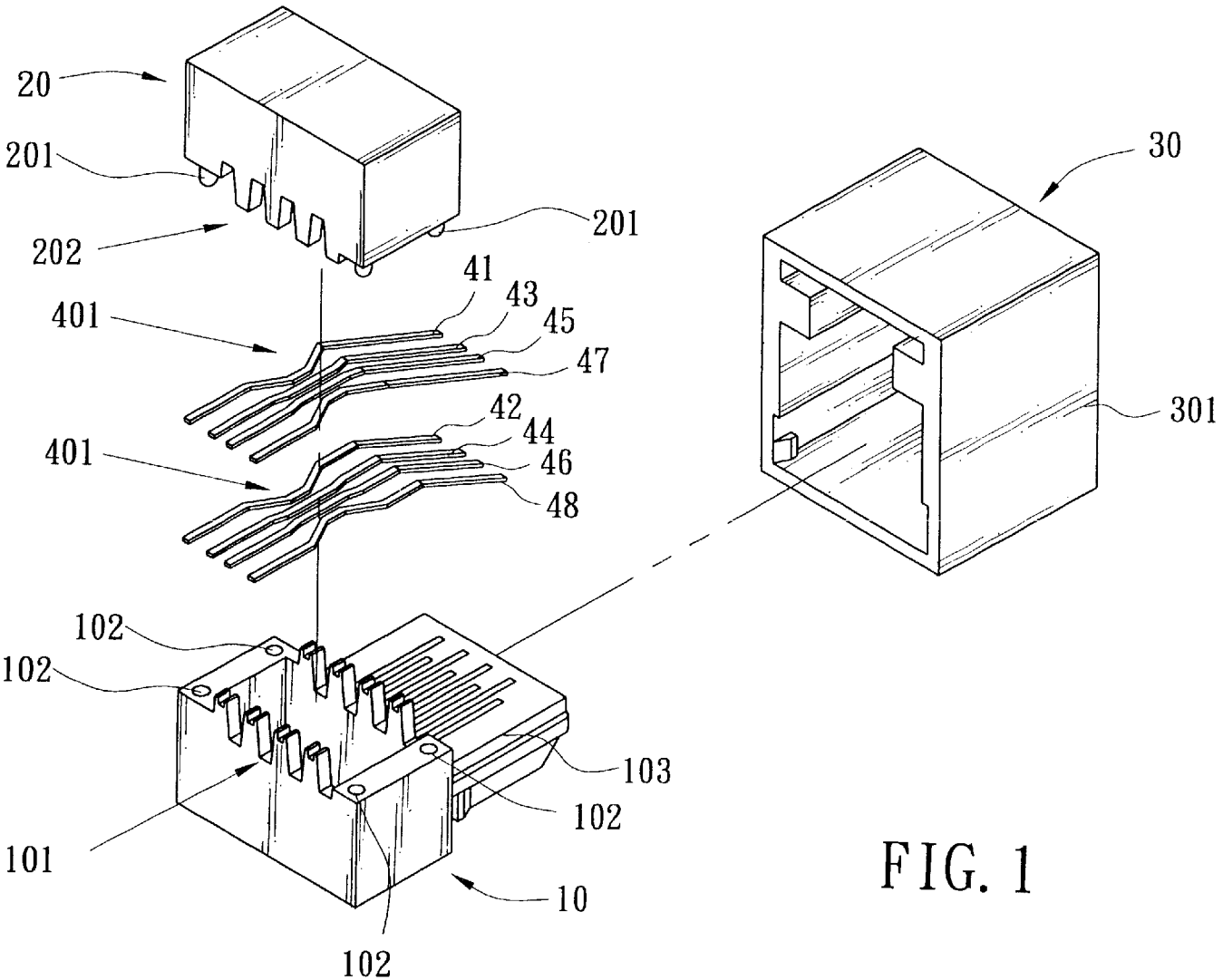
FIG. 1 is an exploded view of an electrical connector according to the present invention.
Figure 2:
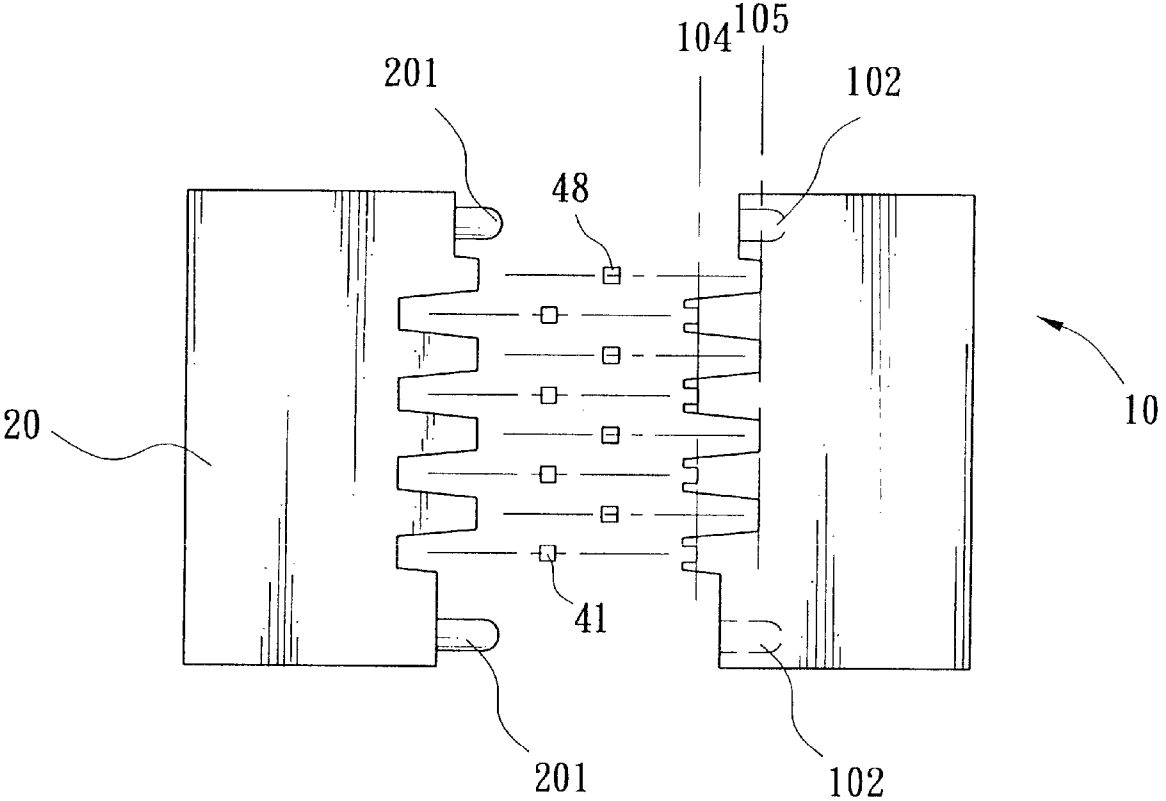
FIG. 2 is a side view of an electrical connector of the present invention.
Figure 3:
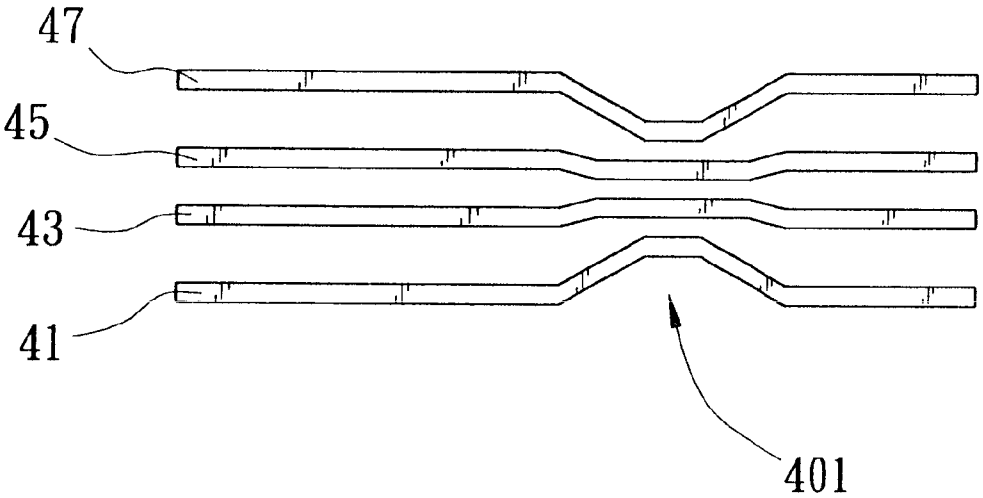
FIG. 3 is a descriptive view of wires in the present invention.

As shown in FIGS. 1 and 2, an electrical connector capable of reducing cross talk according to the present invention includes a seat 10, a pressing element 20, a cap 30 and eight metallic wires 41, 42, 43, 44, 45, 46, 47, 48. The seat 10 is formed with eight grooves 101 where adjacent grooves are located in two different planes 104, 105 which are parallel to each other. The wires 41~48 are mounted into the grooves 101 so that adjacent wires are located in different planes, for example, wires 41, 43, 45, 47 in the grooves on first plane 104; and wires 42, 44, 46, 48 in the grooves on the second plane 105. The wires located in two different planes 104, 105 will cause less cross talk. Those parallel wires located in a same plane, for example, wires 41, 43, 45, 47 in the first plane 104, as shown in FIG. 3, and unshown wires 42, 44, 46, 48 in the second plane 105, are formed into a necked portion 401 where the wires go closer. The necked portions 401 will cause more interference and enhance compensation. The pressing element 20 is formed with grooves and extrusions 202 corresponding to the grooves 101 of seat 10 so as to press and fix the wires 41~48 and the necked portions 401 when the pressing element 20 is being fixed to the seat 10 by positioning four pins 201 formed on the pressing element 20 into four holes 102 formed on the seat 10. There is a bending portion on each wire 41~48 which will be inserted into guiding slots 103 formed on a side portion of the seat 10. Then, the seat 10 and pressing element 20 fixed together are inserted into the cap 30 which serves as a socket 301 for a terminal plug of communication wires.

An experimental comparison of near-end cross talk at 100 MHz between the present invention and prior arts is listed below which shows the improvement of the present invention. The wires 44 and 45 are of Pair 1; the wires 41, 42 are of Pair 2; the wires 43, 46 are of Pair 3; and the wires 47, 48 are of Pair 4.

Near-end cross talk, Category 5e @ 100 MHz
Prior arts vs. Present invention

| | Prior arts | Present invention |
|---|---|---|
| Pairs 1-3 | | |
| Testing plugs 1-3L | −43.26 dB | −45.43 dB |
| Testing plugs 1-3H | −43.83 dB | −47.12 dB |
| Pairs 2-3 | | |
| Testing plugs 2-3L | −48.71 dB | −51.25 dB |
| Testing plugs 2-3H | −46.62 dB | −49.02 dB |
| Pairs 3-4 | | |
| Testing plugs 3-4L | −45.98 dB | −48.09 dB |
| Testing plugs 3-4H | −46.01 dB | −49.12 dB |

Figure 4:
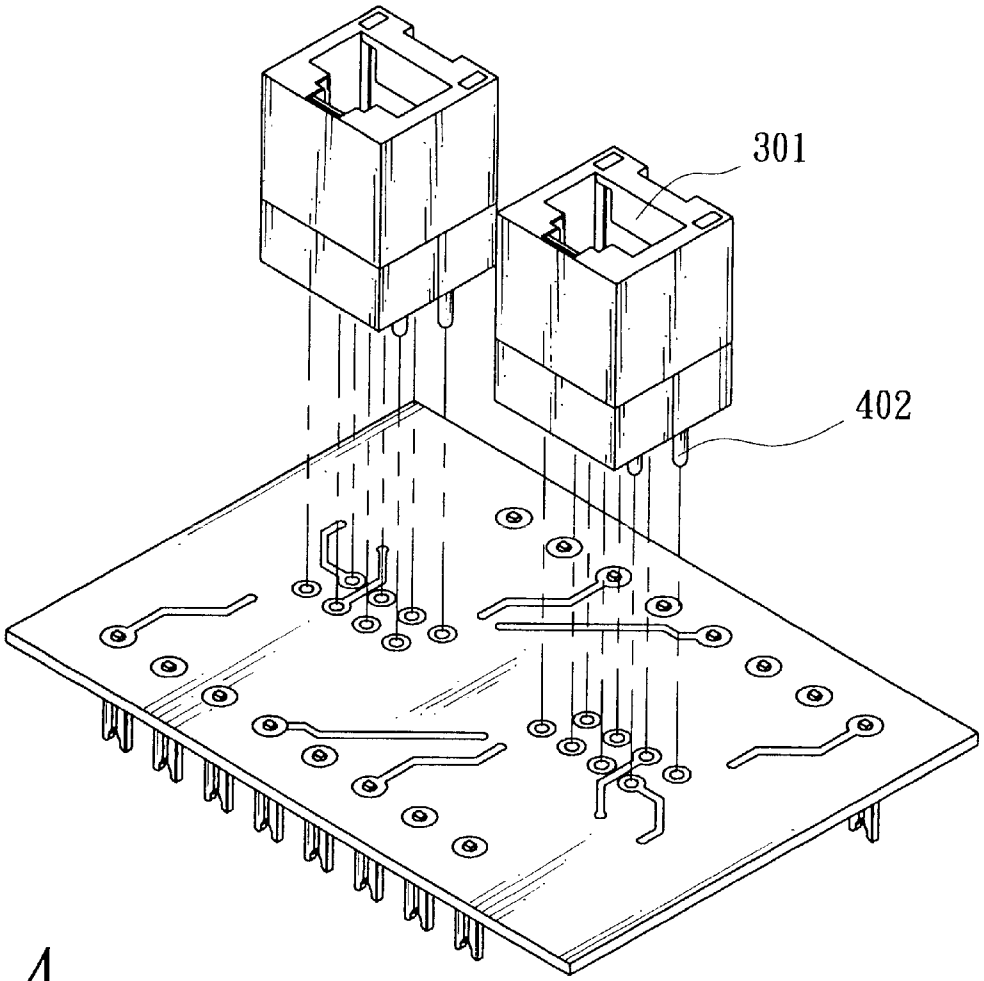
FIG. 4 is a perspective view of an application of the present invention.

Further, the structural design of the present invention makes the mounting legs 402 of the wires 41~48 located in the middle of the connector unit, symmetrically to the center lines of the seat 10 and the pressing element 20. Therefore, when the connector is mounted on a printed circuit board and electrically linked to terminal ports located on both sides of the PC board, as shown in FIG. 4, the electrical paths of a terminal plug to the two sides are equal and electrically equivalent for cross talk.

Figure 5:
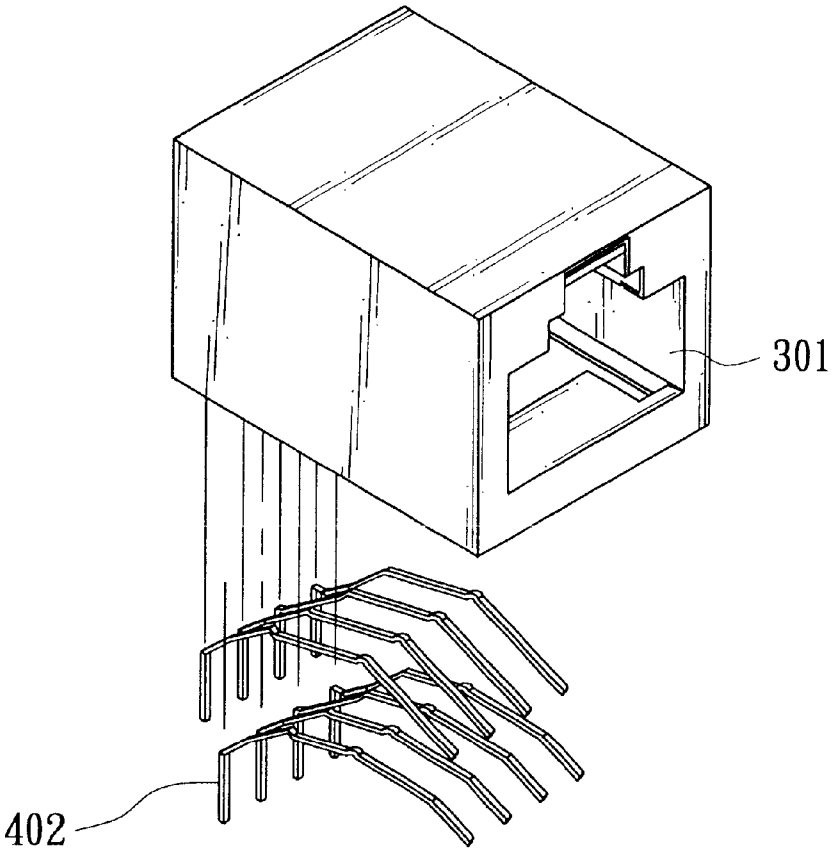
FIG. 5 is a descriptive view of a second embodiment of the present invention.

FIG. 5 shows another embodiment of the present invention where the mounting legs 402 of the wires 41~48 are bent with right angle so that the socket 301 for terminal plug is perpendicular to the mounting legs 402. But, the function and performance remain the same.

As described above, the electrical connector according to the present invention improves the transmission performance and meets the requirements of Category 5e in EIA/TIA standard.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrical connector capable of reducing cross talk, comprising:

a cap, formed with a cavity and a socket for a terminal plug;

a seat, to be inserted into the cavity of said cap, the seat being formed with a plurality of grooves where adjacent grooves are located in two different planes;

a pressing element, to be incorporated with said seat and filled into the cavity of said cap, the pressing element being formed with engaging shapes corresponding to the grooves; and a plurality of uniform sectioned metallic wires, mounted into grooves of said seat and fixed by said pressing element, each having one end inserted into the socket of said cap as a contact for the terminal plug; and the other end as a mounting pin to be mounted into a printed circuit board; whereby the plurality of mounting pins are located symmetrically in the middle portion of said seat and said pressing element; and adjacent wires are located in two different planes; each group of wires located in a plane is further formed with a necked portion where the wires of the group are closer to one another, the necked portion of the wires being fixed by the pressing element.

2. An electrical connector capable of reducing cross talk as recited in claim 1 wherein the grooves of said seat are equally spaced and formed into two planes with adjacent grooves at different planes.

3. An electrical connector capable of reducing cross talk as recited in claim 1 wherein the seat is further formed with a plurality of slots for guiding the ends of wires into the socket.

4. An electrical connector capable of reducing cross talk as recited in claim 1 wherein ends of each wire form a right angle with the socket.

5. An electrical connector capable of reducing cross talk as recited in claim 1 wherein the number of wires is eight.

6. An electrical connector capable of reducing cross talk as recited in claim 1 wherein the grooves of said seat are formed in two parallel planes.

7. An electrical connector capable of reducing cross talk as recited in claim 1 wherein the mounting pins extend in a direction opposite to the socket for the terminal plug.

8. An electrical connector capable of reducing cross talk as recited in claim 1 wherein the mounting pins are perpendicular to the socket for the terminal plug.

* * * * *